United States Patent [19]

Wueger

[11] 4,033,384

[45] July 5, 1977

[54] MEANS FOR AND METHOD OF SUPPLYING WEFT YARN TO AN OUTSIDE FILLING SUPPLY LOOM

[75] Inventor: Karl W. Wueger, North Brookfield, Mass.

[73] Assignee: Crompton & Knowles Corporation, Worcester, Mass.

[22] Filed: Aug. 26, 1974

[21] Appl. No.: 500,427

[52] U.S. Cl. ..... 139/452

[51] Int. Cl.[2] ..... D03D 47/36

[58] Field of Search ..... 139/452, 435; 226/34, 226/118, 97; 224/47.01–47.13, 55; 66/132

[56] References Cited

UNITED STATES PATENTS

| | | | |
|---|---|---|---|
| 3,370,618 | 2/1968 | Svaty et al. | 139/452 |
| 3,825,198 | 7/1974 | Oehninger | 242/55 |
| 3,870,088 | 3/1975 | Scheffel | 139/452 |
| 3,916,935 | 11/1975 | Keldany | 139/452 |

FOREIGN PATENTS OR APPLICATIONS

| | | | |
|---|---|---|---|
| 2,237,068 | 2/1973 | Germany | 139/452 |

*Primary Examiner*—Henry S. Jaudon
*Attorney, Agent, or Firm*—Howard G. Garner, Jr.; Wilfred F. DesRosiers

[57] ABSTRACT

Method of and apparatus for preparing a length of weft yarn in a magazine for insertion in a shuttleless loom. Weft yarn is drawn from a supply package into a storage magazine wherein a helical airflow is created which directs the weft yarn into a helix from which the weft yarn is then withdrawn axially of the helix for insertion into the loom.

10 Claims, 4 Drawing Figures

FIG. 4
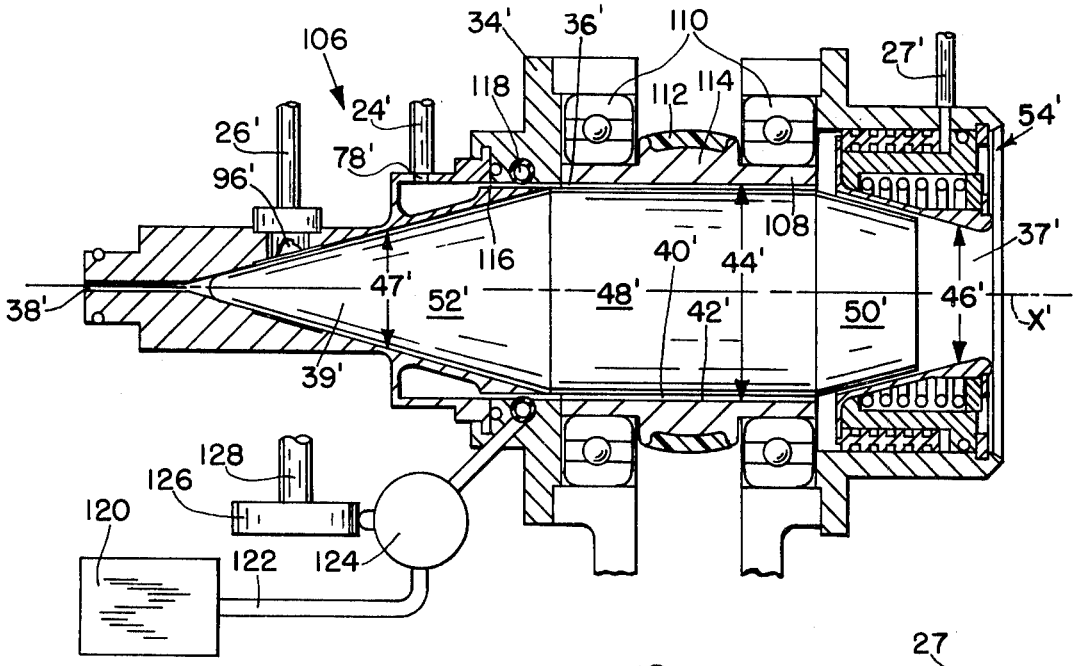
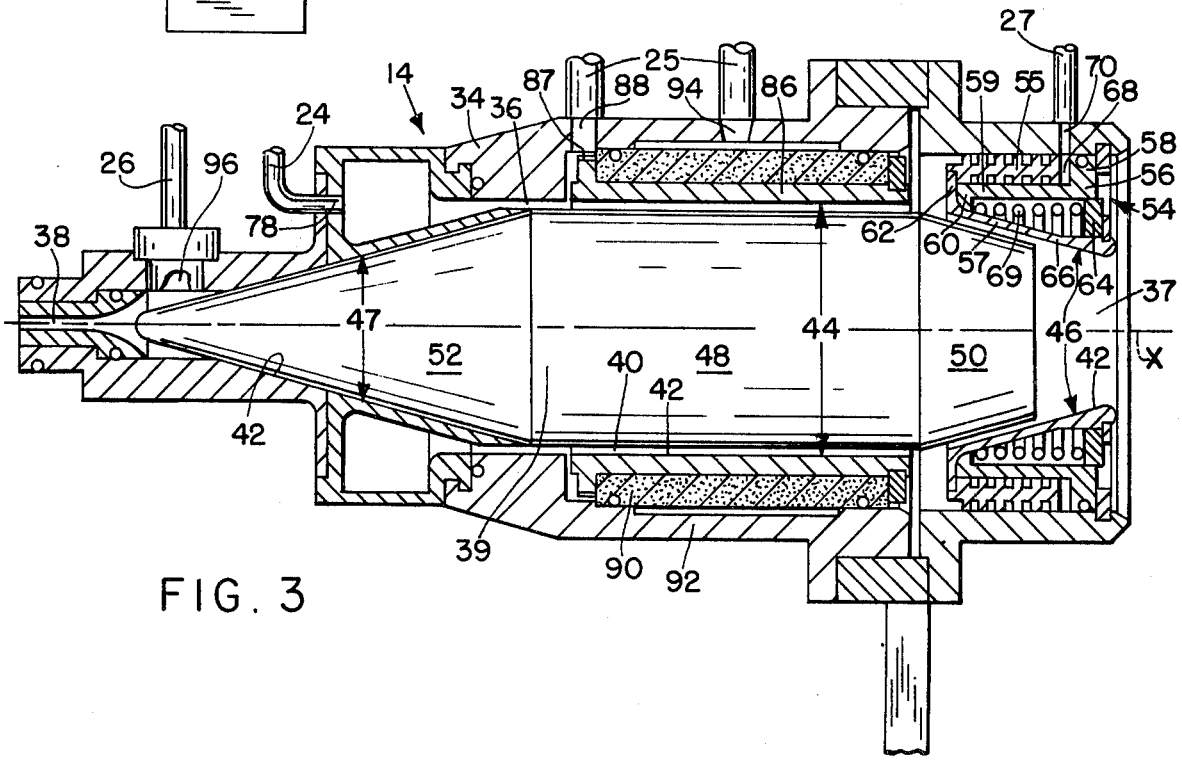
FIG. 3

MEANS FOR AND METHOD OF SUPPLYING WEFT YARN TO AN OUTSIDE FILLING SUPPLY LOOM

BACKGROUND OF THE INVENTION

This invention relates to a method of and apparatus for preparing a length of weft yarn for insertion into a shuttleless loom.

Known dispensing devices include a measuring device which draws the weft yarn from a stationary supply source and winds it on a drum so that the number of loops on the drum determines the measured length. Thereafter, the yarn is taken off the measuring drum and propelled through the warp shed. Experience has shown that there is a certain amount of surface tension between the yarn loops and the drum which must be overcome. With ever increasing loom speeds, it is important that the yarn is drawn into the warp shed with as little resistance as possible.

Other dispensing devices store a length of weft yarn in the form of a loop. This loop may be formed by a light spring or by blowing or drawing the weft yarn into a chamber. The disadvantage of this approach is that in outside filling supply looms, speeds are of such magnitude that the enertial stress on the weft yarn is extreme. The forces required to overcome the spring which holds the loop of weft yarn or to accelerate the loop of weft yarn will interfere with insertion of the weft yarn into the loom or may even result in rupture of the weft yarn.

It is a principal object of the invention to provide a method of and apparatus for yarn dispensing with less resistance than any known type of yarn measuring and dispensing devices and with less enertial stress to the weft yarn than prior art storage devices.

SUMMARY OF THE INVENTION

The principal object of the invention is accomplished by feeding weft yarn from a supply cone into a storage magazine wherein a helical air flow is created which directs the weft yarn into a helix or spatial spiral. The weft yarn is then withdrawn axially of the spiral for insertion into an outside filling supply loom. The magazine comprises a round hollow chamber within which is located a core which forms an annular space. The magazine also includes an inlet opening and an outlet opening. Weft yarn is introduced into the inlet opening and the helical air flow is created within the annular space which directs a length of the weft yarn into a helix or spatial spiral. This length of weft yarn is then withdrawn from the helix and directed through the outlet opening for insertion into the loom.

BRIEF DESCRIPTION OF THE DRAWINGS

FIG. 3 is a horizontal section taken along line 3—3 in FIG. 2 and looking in the direction of the arrows; and FIG. 4 is a sectional view similar to FIG. 3, showing a modified magazine.

DETAILED DESCRIPTION OF THE INVENTION

Figure 1:
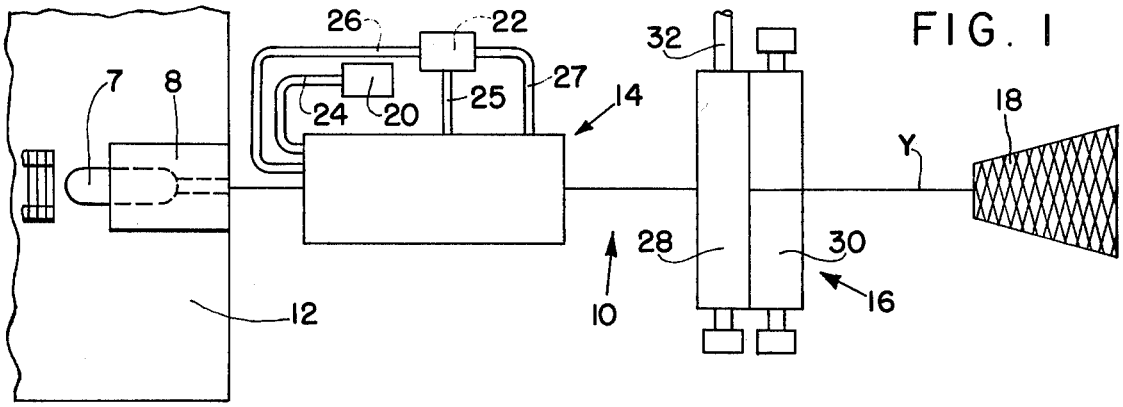
FIG. 1 is a general fragmentary plan view of the invention.

Referring particularly to FIG. 1, the weft yarn preparing apparatus of the present invention is generally indicated by the reference numeral 10 and is shown diagrammatically in association with a loom indicated at 12, only a portion of which is shown. The loom may be of any type in which weft is inserted from outside supply packages as shown, for example, in my U.S. Pat. No. 3,412,763, dated 26 Nov. 1968. In this loom, weft yarn is inserted by means of a gripper projectile 7, which is pneumatically propelled across the loom from a launching device 8. However, this is an example of one type of loom for which the invention may be used.

Apparatus 10 comprises a storage magazine 14, and a weft measuring and feed device 16 which draws weft from a cone 18 and feeds it to the magazine 14. Associated with magazine 14 is a low pressure air source 20 and a high pressure air source 22. Low pressure souce 20 is connected to magazine 14 by an air line 24 for creating sub-atmospheric air pressure within the magazine in a manner to be described. High pressure source 22 is connected to magazine 14 by air lines 25, 26 and 27 for creating super-atmospheric pressure in the magazine in a manner also to be described.

Feed device 16 comprises a pair of feed rolls 28 and 30, at least one of which is positively driven by a shaft 32 driven in timed relation to the loom by interconnected drive means, not shown. Weft yarn will be drawn continuously from the cone 18 at the same rate that yarn is utilized by the loom.

Figure 2:
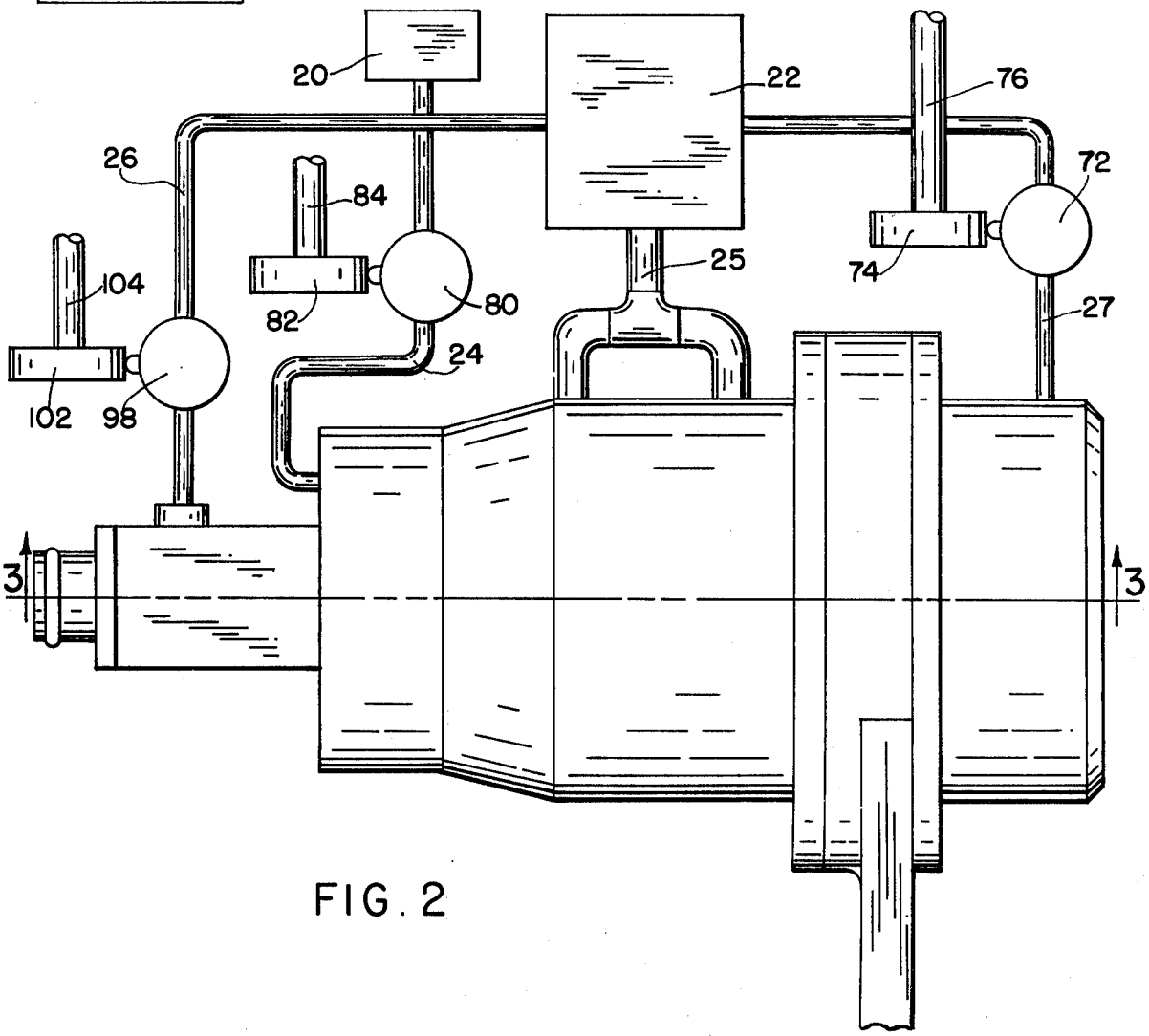
FIG. 2 is a side elevation of the preferred magazine embodiment.

Referring to FIGS. 2 and 3, magazine 14 is shown in greater detail and comprises a housing 34 having a chamber 36 which is circular in cross section, an inlet opening 37, and an outlet opening 38. A core 39 is located within chamber 36 and forms an annular space 40 with the wall 42 of the chamber. Chamber 36 comprises a central cylindrical portion 44, a first frusto-conical portion 46 connecting central portion 44 to inlet opening 37 and a second frusto-conical portion 47 connecting central portion 44 to outlet opening 38. Core 39 has a central cylindrical portion 48, a first frusto-conical portion 50 and a second frusto-conical portion 52. Core 39 is loosely located within chamber 36 and can be moved axially.

When core 39 is moved toward the inlet opening, the first frusto-conical portion 50 will snugly engage the portion of wall 42 which forms the first frusto-conical portion 46 of chamber 36 and thereby effectively seals inlet opening 37 from the portion of annular space 40 around the central cylindrical part of the core 39. When core 39 is moved toward the outlet opening 38, second frusto-conical portion 52 will engage the portion of wall 42 which forms the second frusto-conical portion 46 of chamber 36 and thereby seals outlet opening 38 from the portion of annular space 40 around the central part of the core.

Core 39 is shifted toward outlet opening 38 by an actuator generally indicated by the reference numeral 54. Actuator 54 includes an outer ring 55, a middle ring 56 and an inner ring 57. Middle ring 56 comprises an annular outer portion 58 by which it is fixed to the housing 34 of magazine 14, an annular central horizontal portion 59 and an inner annular lip portion 60. Inner ring 57 is generally located within ring 56 and comprises a first annular projection 62 which extends beyond the inner end of middle ring 56 and outwardly from the central longitudinal axis X of the magazine beyond portions 59 and 60 of the middle ring 56. Ring 57 also comprises a second annular projection 64 which abuts the inner surface of the central portion 59 of the middle ring, and an intermediate portion 66 which connects the first and second annular projections. Portion 66 also forms the second frusto-conical portion 46 of the chamber 36. Outer ring 55 is slidably mounted on the outside of central portion 59 along the axis X and is confined between projection 62 of the inner ring and outer portion 58 of the middle ring. An annular space 68 is formed between outer ring 55 and portion 58 of the middle ring. A spring 69 extends between projection 64 and lip 60 to maintain projection 62 against lip 60. A port 70 is alligned with space 68 and is pneumatically connected with high pressure source 22 through air line 27. A valve 72 is located in line 27 and is opened and closed by a cam 74 driven by a shaft 76 which in turn is driven in timed relation with the loom by interconnected drive means, not shown. At the proper time in the loom cycle, cam 74 opens valve 72 so that air at superatmospheric pressure enters space 68 and drives outer ring 55 inwardly to the left as viewed in FIG. 3. Since outer ring 55 bears against projection 62, inner ring 57 is also driven inwardly against the action of spring 69 to push core 39 to the left to the position it occupies in FIG. 3. When core 39 is moved to the right by means to be described, valve 72 is again closed so that actuator 54 will engage portion 50 of the core just prior to its movement to the right. Just as core 39 begins to move to the right as viewed in FIG. 3, valve 72 will be closed. Valve 72 is a three way valve which dumps the pressurized air between the valve and actuator 54 when the valve is closed. Spring 69 will return inner ring 66 to its original position. This dumping can be instantaneous or slow so that the movement of actuator 54 to the right, as viewed in FIG. 3, will match the movement of the core 39 in that direction. In this way, inner ring 66 will act as a guide for the core and maintain it in allignment along axis X, so that space 40 will be uniform and core 39 will not strike wall 42.

The means for creating an air flow from inlet opening 37 into space 40 comprises an exhaust port 78 in housing 34 which is pneumatically connected to space 40. Port 78 is pneumatically connected to low pressure source 20 by air line 24. A valve 80 is located in line 24 and is opened and closed by a cam 82, which is driven by a shaft 84, driven in timed relaton with the loom by interconnected drive means, not shown. When valve 80 is opened by cam 82, air is drawn from the magazine by source 20, so that sub-atmospheric pressure is created at the port 78. The effect of this sub-atmospheric pressure draws air through space 40 from inlet opening 37.

The means for making the air flow within space 40 helical, comprises a ring 86 which forms the wall of the central cylindrical portion of chamber 36. A series of spaced turbine blades 87 are annularly arranged on the outside of ring 86 and are alligned with a port 88 which is pneumatically connected by air line 25 to high pressure source 22. Air at super atmospheric pressure from source 22 is directed against turbine blades 87 to cause ring 86 to rotate around axis X. The rotation of ring 86 will cause the air passing from inlet opening 37 to port 78 to flow helically. Weft yarn, indicated by the reference numeral Y, is fed to inlet opening 37 from feed device 16 and is drawn into the space 40 by the helical air flow therein. Weft yarn drawn into space 40 is deposited on the portion 48 of core 39 in the form of a helix or spatial spiral. A porous graphite bearing ring 90 is mounted between ring 86 and the outer wall 92 of housing 34. Air at super-atmospheric pressure is introduced through a port 94 which is pneumatically connected to bearing ring 90. Pressurized air is supplied to port 94 from air line 25 and permeates bearing 90 to decrease the fricton between ring 86 and bearing 90 and enables ring 86 to rotate with very little frictional resistance.

The means for withdrawing the weft helically deposited on core 39 comprises a port 96 located adjacent outlet opening 38 and the end of second frusto-conical portion 52. Port 96 pneumatically connects chamber 36 to high pressure souce 22 by means of air line 26. A valve 98 is located in line 26 and, upon being opened, allows air at super-atmospheric pressure to enter port 96 from source 22. Valve 98 is opened and closed by a cam 102 mounted on a shaft 104 which is rotated in timed relation with the loom in the same manner as shafts 76 and 84. At the proper time during the loom cycle, valve 98 is opened and valves 80 and 72 are closed so that chamber 36 is pressurized from port 96. This forces core 39 to the right as viewed in FIG. 3 and causes portion 50 of the core to seat within portion 46 of the chamber and seal inlet opening 37 from space 40. At the same time, the seal between portion 52 of the core and the portion of wall 42 which defines portion 47 of the chamber, is broken. Since valve 80 is closed and opening 37 sealed, the pressurized air within chamber 36 will escape through outlet opening 38. The helically wound yarn on core 39 will be drawn out through opening 38 axially of the core by this air flow. This discharge of weft yarn from the magazine will be effective to insert the weft into the warp shed or to assist the insertion of weft therein by a projectile such as projectile 7 shown in FIG. 1. This length of weft yarn will be drawn from the helix with extremely little resistance.

The valves 72, 80 and 98 are timed so that core 39 is reciprocated within chamber 36 once for each weft insertion. Valve 72 is open long enough to enable enough weft yarn to be wound on core 39 for one weft insertion. Valve 98 is opened and valves 72 and 80 are closed to allow core 39 to be shifted to the right as viewed in FIG. 3, just prior to weft insertion into the warp shed of the loom.

Referring to FIG. 4, there is shown a modified magazine 106 which comprises a housing 34′ which contains a chamber 36′ and core 39′. Chamber 36′ and core 39′ are identical to chamber 36 and core 39, respectively. Housing 34′ has an inlet opening 37′ and an outlet opening 38′. The mechanisms for shifting core 39′ along the central longitudinal axis X′ of the housing are identical to those of the magazine shown in FIG. 4 and identical elements have the same reference numerals, except that the elements in magazine 106 are suffixed with a prime. Magazine 106 differs from magazine 14 by the means for creating a helical airflow in the space 40′ between the central part of core 39′ and the wall 42′ of the chamber 36′. The means for creating a helical airflow within space 40′ comprises a ring 108 which forms the central portion 44′ of the chamber 39′. Ring 108 is mounted for rotation around axis X′ within bearings 110. This rotation causes air passing through space 40′ to flow helically in the same manner as ring 86. Ring 108 is rotated by means of a belt 112 which drivingly engages a sheave 114 fixed to the outside of ring 108. Belt 112 is driven by conventional drive means, not shown. An exhaust port 78′ in housing 34′ is pneumatically connected to space 40′ by an annular channel 116. Air line 24′ is connected to a low pressure source for creating sub-atmospheric air pressure in port 78′ in the same manner as in the first embodiment, except that there is no valve in line 24′. Instead, there is an annular expandable resilient tube 118 which lies partially within channel 116 which is effective when expanded to completely block channel 116 and thereby prevent air from passing from space 40' to port 78'. Tube 118 is pneumatically connected to a high pressure source 120 by an air line 122. A valve 124 is located in air line 122 and is opened and closed by a cam 126 fixed to a shaft 128 which is driven in timed relation to the loom by interconnecting drive means, not shown. The opening and closing of valve 124 is such that tube 118 will be deflated during the period of time that weft yarn is being deposited on core 39' and inflated when weft yarn is being withdrawn from the magazine to the loom.

I claim:

1. Apparatus for preparing a length of weft yarn in a magazine for weft insertion in a shuttleless loom comprising:

a. a housing having a chamber which is circular in cross section, an inlet opening connected to one end of said chamber, and an outlet opening connected to the opposite end of said chamber;

b. means for feeding weft yarn to said inlet opening from a supply package;

c. a core movable along its longitudinal axis within said chamber and which cooperates with the inner wall of said chamber to form an annular space therebetween;

d. first actuator means for creating an air flow from said inlet opening to said annular space and for creating a helical air flow within said annular space for depositing a length of weft yarn within said annular space in a helix; and e. second actuator means for axially withdrawing said length of weft yarn from said annular space through said outlet opening for insertion in a shuttleless loom.

2. The apparatus as set forth in claim 1 wherein said core is movable along its longitudinal axis between an outer position where it is effective to seal said outlet opening from said annular space and an inner position where it is effective to seal said inlet opening from said annular space, said first actuator means being effective to move said core to its outer position and said second actuator means being effective to move said core to its inner position.

3. The apparatus as set forth in claim 2 wherein said chamber comprises a central cylindrical portion, a first frusto-conical portion connecting said central portion to said inlet opening and a second frusto-conical portion connecting said central portion to said outlet opening, said core having a central cylindrical portion and first and second frusto-conical end portions for sealing engagement with the first and second frusto-conical sections, respectively, of said chamber when said core is in its inner and outer positions, respectively.

4. The apparatus as set forth in claim 3 wherein said first actuator means comprises:

a. an exhaust port within said housing pneumatically connected to the outlet end of said annular space;

b. a source of sub-atmospheric air pressure;

c. means for connecting said exhaust port to said source of sub-atmospheric air pressure to create an air flow within said annular space toward said exhaust port;

d. a ring mounted for rotation around the longitudinal axis of said chamber and forming the wall of the central cylindrical portion of said chamber; and e. means for rotating said ring to cause the airflow within said annular space to flow helically.

5. The apparatus as set forth in claim 4 wherein the means for rotating said ring comprises:

a. a sheave fixed to the outside of said ring; and b. drive means for rotating said sheave.

6. The apparatus as set forth in claim 4 wherein the means for rotating said ring comprises:

a. a plurality of spaced turbine blades mounted on said ring; and b. means for directing a stream of air at super-atmospheric pressure against said turbine blades.

7. The apparatus as set forth in claim 4 wherein the means for axially withdrawing a length of weft yarn from said annular space comprises:

a. means for shifting said core toward said inlet opening to seal said inlet opening from said annular space; and b. valve means for shutting off the air flow from said annular space to said exhaust port so that the air flow within said annular space is directed out of said outlet opening, whereby said length of weft yarn is blown out of said outlet opening.

8. The apparatus as set forth in claim 7 wherein said apparatus comprises an annular passageway pneumatically connecting said exhaust port to said annular space and wherein said valve means comprises:

a. an annular inflatable resilient tube located adjacent said annular passageway, said tube allowing air to pass through said annular passageway when said tube is deflated and effective, when inflated, to seal said passageway from air flow from said annular space to said exhaust port;

b. a source of air at super-atmospheric pressure pneumatically connected to said tube; and c. a valve interposed between said source and said tube.

9. The apparatus as set forth in claim 7 wherein said valve means is effective to seal said exhaust port from said source of sub-atmospheric air pressure and from any airflow through said exhaust port.

10. The apparatus as set forth in claim 3 wherein the means for shifting said core toward said inlet opening comprises:

a. an actuator port located between said outlet opening and the central cylindrical portion of said chamber and connecting said chamber to the outside of said housing; and b. means for creating a super-atmospheric pressure within said actuator port.

* * * * *